US006431770B1

(12) United States Patent
Kurematsu et al.

(10) Patent No.: US 6,431,770 B1
(45) Date of Patent: Aug. 13, 2002

(54) AUTOMATIC PROCESSING APPARATUS FOR PHOTOSENSITIVE MATERIAL

(75) Inventors: Masayuki Kurematsu; Hiroyuki Hashimoto; Hiroaki Kobayashi, all of Tokyo (JP)

(73) Assignee: KonicaCorporation, Tokyo (JP)

( * ) Notice: Subject to any disclaimer, the term of this patent is extended or adjusted under 35 U.S.C. 154(b) by 0 days.

(21) Appl. No.: 09/941,404

(22) Filed: Aug. 28, 2001

(30) Foreign Application Priority Data

Aug. 31, 2000 (JP) ..... 2000-263782

(51) Int. Cl.[7] ..... G03D 3/02; G03D 3/08
(52) U.S. Cl. ..... 396/612; 396/627
(58) Field of Search ..... 396/612, 617, 396/620, 626, 625; 355/27–29, 40, 41, 77

(56) References Cited

U.S. PATENT DOCUMENTS 4,334,758 A * 6/1982 Leveille ..... 118/114
5,477,301 A * 12/1995 Earle et al. ..... 347/1
5,834,155 A * 11/1998 Uehara ..... 396/604
5,975,774 A * 11/1999 Blakely et al. ..... 396/617

FOREIGN PATENT DOCUMENTS

JP 10-326004 * 12/1998
JP 11-237724 * 8/1999

* cited by examiner

*Primary Examiner*—D. Rutledge
(74) *Attorney, Agent, or Firm*—Squire, Sanders & Dempsey L.L.P.

(57) ABSTRACT

An automatic processing apparatus for processing an exposed photographic light-sensitive material by coating a processing solution on the photographic material, comprising: a conveying device having a conveying path for conveying the photographic material in a conveying direction while inclining the photographic material downward in the conveying direction; and a coating device for coating the processing solution on an inclined portion of the photographic material in a line form in a direction perpendicular to the conveying direction.

13 Claims, 15 Drawing Sheets

AUTOMATIC PROCESSING APPARATUS FOR PHOTOSENSITIVE MATERIAL

FIELD OF THE INVENTION

The present invention relates to an automatic processing apparatus for photosensitive materials that is excellent in rapid processing capability and is capable of obtaining prints with stable image quality no matter how the day's amount of processing is small.

BACKGROUND OF THE INVENTION

As an automatic processing apparatus for photosensitive material exposing a photosensitive material and processing the exposed photosensitive material by a processing solution, there has been one that leads and immerses the photosensitive material to a processing solution tank to process.

In recent years, with a sudden increase of the number of minilabs characterized in rapid finishing, an amount of processing of photosensitive materials per one minilab has been reduced, and a rate of renewal of a processing solution in a processing tank has been lowered accordingly. Therefore, a processing solution tends to be deteriorated, and it also tends to fail in maintaining stable processing performance. In addition, demands for a minilab that does not require maintenance such as cleaning of equipment and daily management are also increasing in recent years.

With the background stated above, TOKKAIHEI Nos. 6-324455, 9-114068, 10-326004 and 11-237724 disclose technologies wherein a processing solution for processing photosensitive materials is housed in a highly-hermetic container (for example, an inkjet head) and the processing solution is supplied to an emulsion side of the photosensitive material through a gaseous phase.

Compared with a method to lead photosensitive materials to a processing solution tank to immerse them therein for continuous processing, the aforesaid method for coating the processing solution has less fluctuation in development finishing, because fresh processing solutions are always supplied for processing. In addition, a processing solution in the processing solution tank is deteriorated through aging, resulting in fluctuation of development finishing caused by the deterioration, but this fluctuation is less for the method for coating the processing solution, because of a system to supply a small amount of fresh processing solution. Furthermore, neither processing solution tank for reserving a processing solution nor rack for conveying a photosensitive material in the processing solution tank is needed, and it is not necessary to take out the rack in maintenance, thus, no processing solution spills over, making maintenance to be easy.

However, when processing by coating a processing solution on the exposed photosensitive material, there has been the possibility that a processing solution flows back in the direction opposite to that for advancement of the photosensitive material to cause processing unevenness, depending on the direction of coating the processing solution.

It is also conducted that a photosensitive material in a specific size is obtained by cutting from a long photosensitive material, and this sheet-shaped photosensitive material obtained through cutting is exposed to light to be subjected to processing. In the case of conducting this processing through the method of coating, when there are plural processing steps, it is necessary to convey a photosensitive material for coating a processing solution for the following step, after coating the initial processing solution on the surface of the photosensitive material. This conveyance caused fluctuation in processing property, resulting in a fear to cause unevenness in processing.

SUMMARY OF THE INVENTION

The invention has been achieved in view of the actual conditions stated above, and an object of the invention is to provide an automatic processing apparatus for photosensitive materials that is free from processing unevenness, excellent in rapid processing capability and is capable of obtaining stable image quality with less maintenance and daily management no matter how an amount of processing is small.

The inventors of this invention, therefore, made various studies to solve the problems mentioned above, and found out that the problems are solved by the following structures.

Structure 1

An automatic processing apparatus for processing an exposed photographic light-sensitive material by coating a processing solution on the photographic material, comprising:

a conveying device having a conveying path for conveying the photographic material in a conveying direction while inclining the photographic material downward in the conveying direction; and a coating device for coating the processing solution on an inclined portion of the photographic material in a line form in a direction perpendicular to the conveying direction.

By coating a processing solution on an inclined portion of a photosensitive material conveyed to be inclined downward in its advancing direction in a line form in the direction that is almost perpendicular to the advancing direction of the photosensitive material, it is possible to prevent that the processing solution flows back in the direction opposite to the advancing direction, resulting in uniform finishing without processing unevenness.

Structure 2

The automatic processing apparatus according to structure 1, wherein the conveying device conveys the photographic material while inclining the photographic material within a range of 2 to 20° downward in the conveying direction.

When a photosensitive material is conveyed to be inclined within a range of 2–20°, a processing solution does not flow back in the direction opposite to the advancing direction of the photosensitive material, and it does not flow fast in the advancing direction, resulting in uniform finishing without processing unevenness.

Structure 3

The automatic processing apparatus according to structure 1, wherein the coating device coats the processing solution on the photographic material by jetting the processing solution from a spray nozzle through a gaseous phase.

It is preferable that the method to coat a processing solution by jetting it from a spray nozzle to the photosensitive material through a gaseous phase can conduct processing without giving causes for processing unevenness such as vibration, deformation, conveyance stop and slip to the photosensitive material.

Structure 4

The automatic processing apparatus according to structure 1, further comprising a processing solution removing device to remove the processing solution from the photographic material with a pair of nip rollers on a condition that the photographic material is inclined downward in the conveying direction before the conveying device conveys the photographic material to a succeeding processing section after the coating device has coated the processing solution on the photographic material.

By removing processing solutions with paired nip rollers for the photosensitive material inclined downward in its advancing direction, after the initial processing solution is coated on the surface of the photosensitive material and before the processing solution for the succeeding step is coated, when the automatic processing machine has therein a plurality of processing steps, it is possible to prevent that the initial processing solution is mixed with the processing solution for the succeeding step, and that the processing solution flows back in the direction opposite to the advancing direction of the photosensitive material, resulting in uniform finishing.

Structure 5

The automatic processing apparatus according to structure 4, wherein the conveying device conveys the photographic material while inclining the photographic material within a range of 2 to 20° downward in the conveying direction.

When a photosensitive material is conveyed to be inclined within a range of 2–20°, a processing solution does not flow back in the direction opposite to the advancing direction of the photosensitive material, and it does not flow fast in the advancing direction, resulting in uniform finishing without processing unevenness.

Structure 6

The automatic processing apparatus according to structure 4, wherein the photographic material is a silver halide color photographic light-sensitive material; the processing solution is a color developing solution; the succeeding processing section is a bleaching fixing process using a bleaching fixing solution and the succeeding processing section comprises a second coating device for coating a bleach-fixing solution on the photographic material by jetting the bleach-fixing solution from a spray nozzle through a gaseous phase.

It is preferable that the method to jet a processing solution from a spray nozzle to a photosensitive material through a gaseous phase makes it possible to conduct processing without causing factors for processing unevenness such as vibration, deformation, conveyance stop and slipping, for the photosensitive material.

Structure 7

An automatic processing apparatus for processing an exposed photographic light-sensitive material by coating a processing solution on the exposed photographic material, comprising:

a conveying device having a conveying path for conveying the exposed photographic material in a conveying direction, a coating device for coating the processing solution on the exposed photographic material by jetting the processing solution from a spray nozzle through a gaseous phase in a direction inclined to the conveying direction with an inclination angle of 70 to 88°.

When an angle of a processing solution jetted from a spray nozzle is 70–88°, a processing solution does not flow back in the direction opposite to the advancing direction of the photosensitive material, and it does not flow fast in the advancing direction of the photosensitive material, resulting in uniform finishing without processing unevenness.

Structure 8

The automatic processing apparatus according to structure 7, wherein the coating device jets the processing solution downward vertically from the spray nozzle, and the conveying device conveys the photographic material while inclining the photographic material downward in the conveying direction.

Owing to the structure wherein the spray nozzle jets downward vertically and the photosensitive material is conveyed obliquely, it is possible to provide an angle in a simple structure.

Structure 9

The automatic processing apparatus according to structure 1, wherein the coating device coats the solution in a coating line perpendicular to the conveying direction and the conveying device comprises one of a comb-toothed roller and a wart roller to convey the photographic material to the coating line, and the one of a comb-toothed roller and a wart roller contacts with a surface of a photosensitive side of the photographic material.

After a processing solution is coated on a photosensitive side of the photosensitive material, it is necessary to convey the photosensitive material on which the processing solution has been coated, and it is possible to convey the photosensitive material surely without causing fluctuation (processing unevenness) on processing property, by using a comb-toothed roller or a wart roller that comes in contact with a photosensitive side of the photosensitive material.

Structure 10

The automatic processing apparatus according to structure 9, wherein the one of a comb-toothed roller and a wart roller is pared with a flat roller so as to form a pair of nip rollers and the flat roller is provided at a reverse side of the photographic material so that the photographic material is conveyed between the pair of nip rollers.

It is possible to convey surely without causing fluctuation of processing property (processing unevenness), by the use of the conveyance by paired nip rollers wherein a flat roller is arranged for the reverse side of the photosensitive material, in place of a comb-toothed roller or a wart roller.

Structure 11

The automatic processing apparatus according to structure 9, wherein a pitch of crests of comb-teeth of the comb-toothed roller is in a range of 1–5 mm and a depth of a root of a comb-tooth of the comb-toothed roller is in a rage of 0.3–5 mm.

It is possible to convey more surely without causing fluctuation of processing property (processing unevenness), by the use of the comb-toothed roller mentioned above.

Structure 12

The automatic processing apparatus according to structure 9, wherein an interval between warts of the wart roller is within a range of 1–5 mm and a height of a wart of the wart roller is within a range of 0.3–5 mm.

It is possible to convey more surely without causing fluctuation of processing property (processing unevenness), by the use of the wart roller mentioned above.

Structure 13

The automatic processing apparatus according to structure 10, wherein the conveying device comprises a pair of squeezing flat rollers before the conveying device conveys the photographic material to a succeeding processing section after the coating device has coated the processing solution onto the photographic material.

It is possible to prevent processing unevenness by removing the first processing solution through squeezing and by coating a processing solution for the succeeding step.

Structure 14

The automatic processing apparatus according to structure 9, wherein the conveying device comprises a hard roller.

After a processing solution is coated on a photosensitive side of the photosensitive material, it is necessary to convey the photosensitive material on which the processing solution has been coated, and when a rubber roller is used as a conveyance means, a processing solution sometimes adheres and remains on the rubber surface to cause processing unevenness, but in the case of a hard roller, a processing solution neither adheres nor remains, resulting in no processing unevenness, which is preferable.

Structure 15

The automatic processing apparatus according to structure 1, wherein the hard roller is one of a comb-toothed roller and a wart roller which is paired with a flat roller.

When the hard roller stated above is represented by paired nip rollers composed of a comb-toothed roller and a flat roller or of a wart roller and a flat roller, a processing solution does not adhere to remain, and processing unevenness is not caused, which is preferable.

Structure 16

The automatic processing apparatus according to structure 15, wherein when the photographic material is a silver halide color photographic light-sensitive material and the processing solution is a color developing solution, roller coming in contact with the color developing solution are the hard roller.

When all rollers coming in contact with the chromogenic developer are hard rollers on the occasion where the photosensitive material is a silver halide color photosensitive material and the processing solution mentioned above is a chromogenic developer, processing unevenness in the form of a spot in a cyanic color can be prevented, which is preferable.

BRIEF OF THE DRAWINGS

Figure 5:
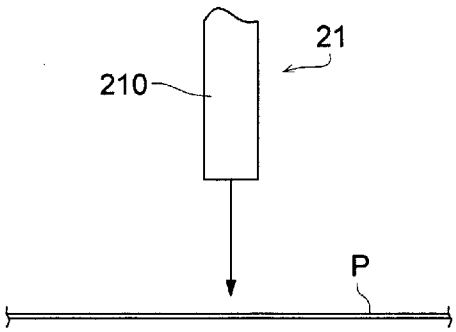
Figure 5:
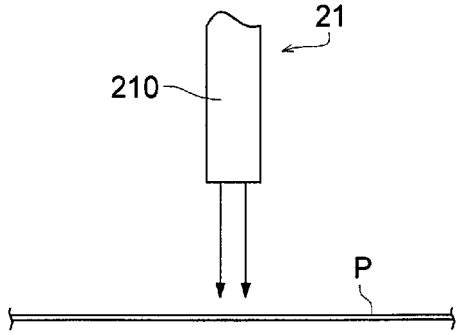
Figure 5:
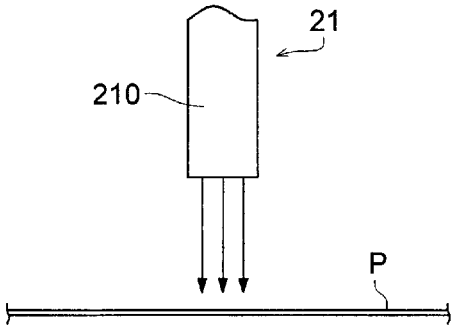
Figure 5:
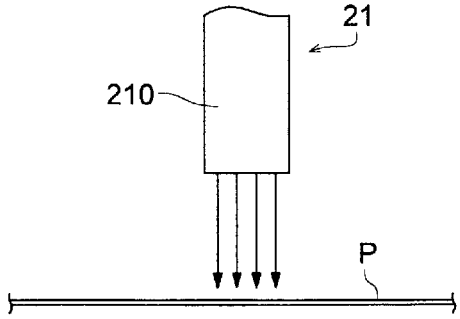
Figure 5:
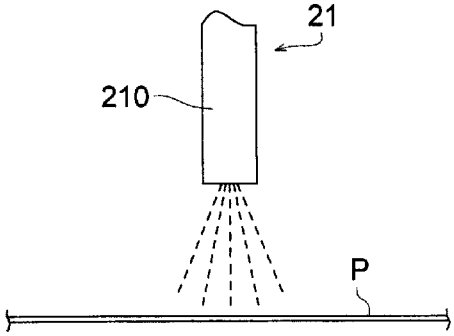

FIGS. 5(*a*) to 5(*e*) are diagrams showing the structures of processing solution coating devices.

Figure 6:
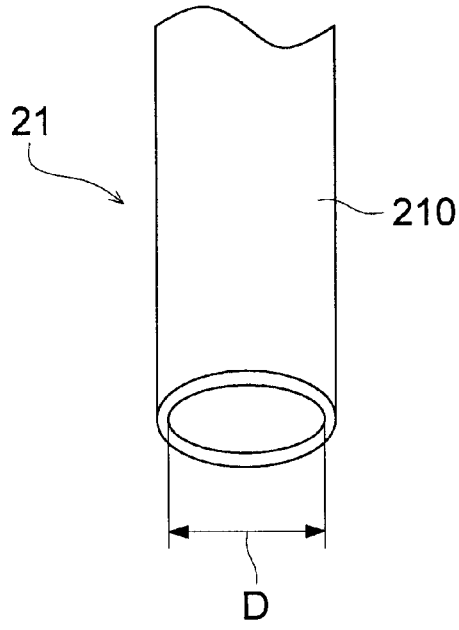

FIG. 6 is a diagram showing the structure of a processing solution-coating device.

Figure 7:
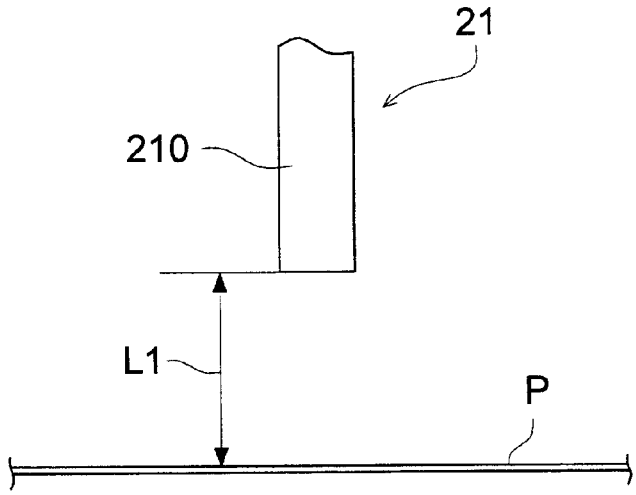

FIG. 7 is a diagram showing the relation between a processing solution-coating device and a photosensitive material.

Figure 8:
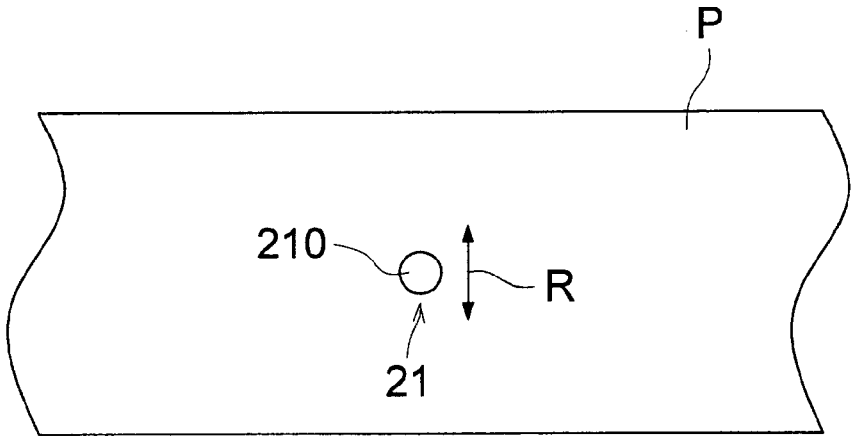

FIG. 8 is a diagram showing the structure of a coating line coated by a processing solution coating device.

Figure 9:
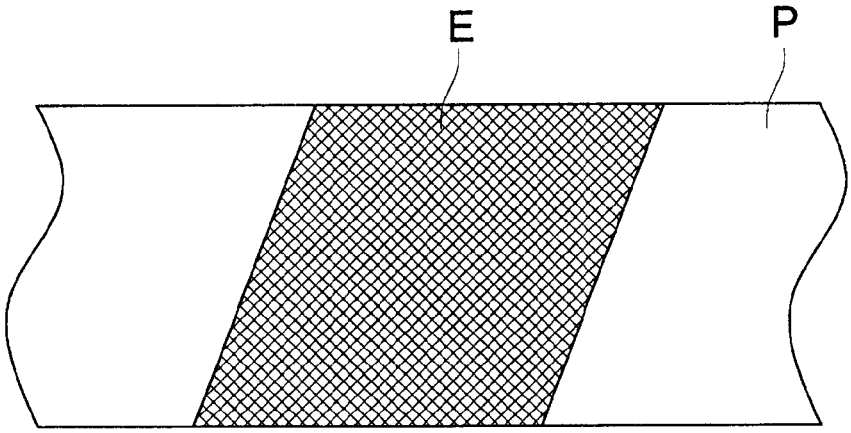

FIG. 9 is a diagram showing an amount of a processing solution to be supplied to a photosensitive material per a predetermined area.

Figure 10:
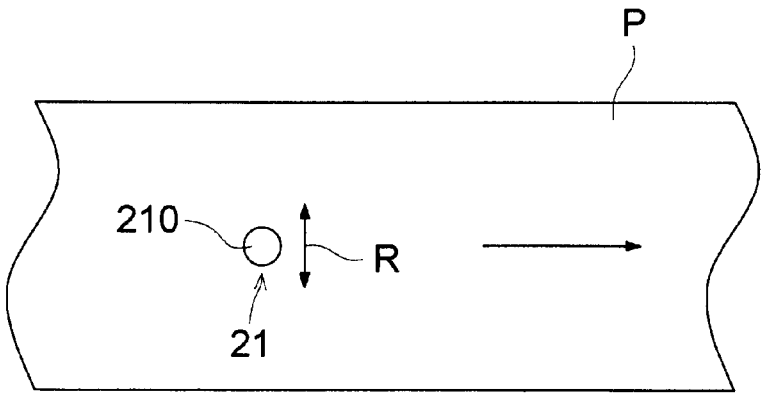

FIG. 10 is a diagram showing a moving direction of a processing solution coating device and a conveying direction a photosensitive material.

Figure 11:
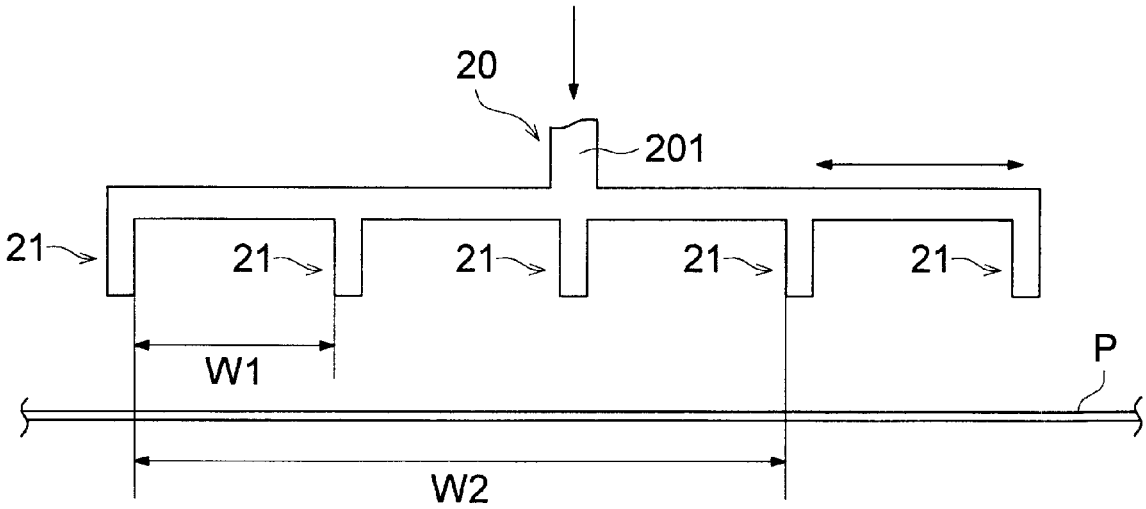

FIG. 11 is a diagram showing the structure of another example of a processing solution coating device.

Figure 12:
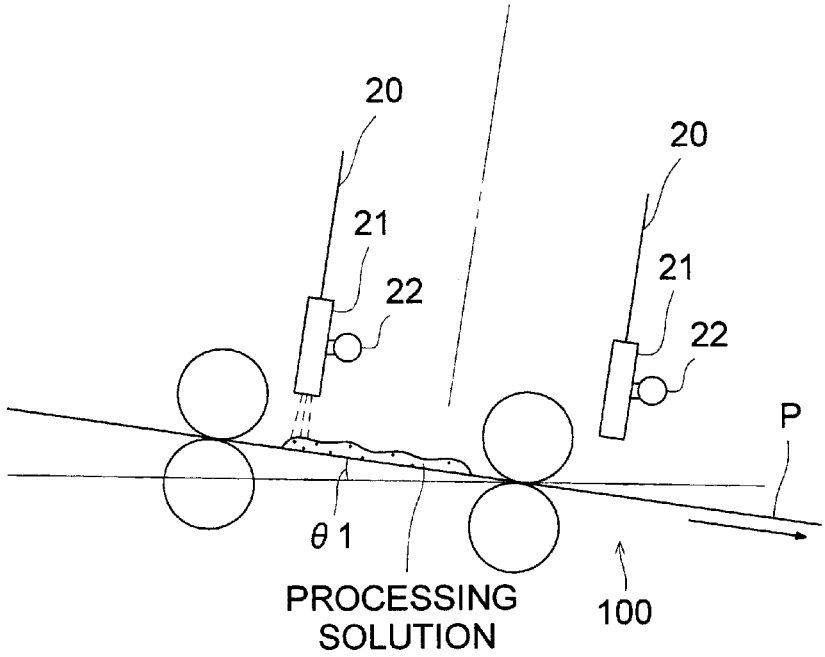

FIG. 12 is a diagram showing a conveyance path to convey a photosensitive material inclined downward in its advancing direction.

Figure 13:
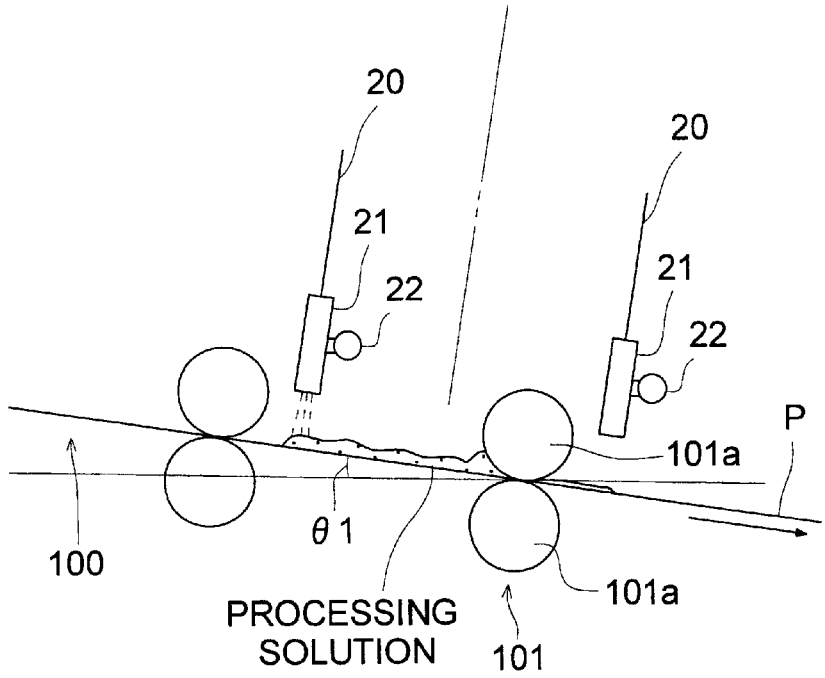

FIG. 13 is a diagram showing a conveyance path to convey a photosensitive material inclined downward in its advancing direction.

Figure 14:
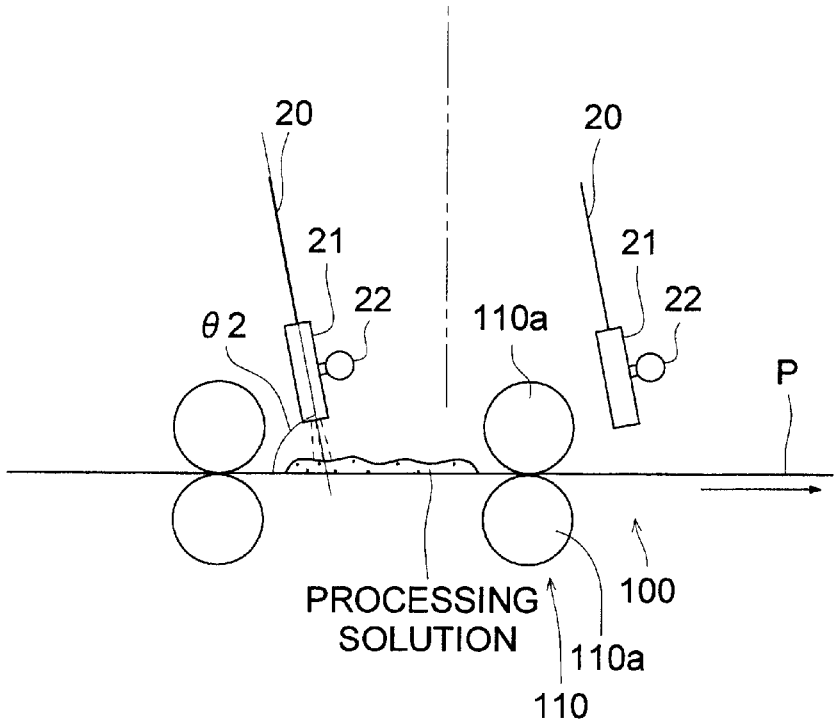

FIG. 14 is a diagram showing a processing solution coating means wherein a direction of a processing solution jetted from a spray nozzle is inclined from an advancing direction of a photosensitive material by a prescribed angle.

Figure 15:
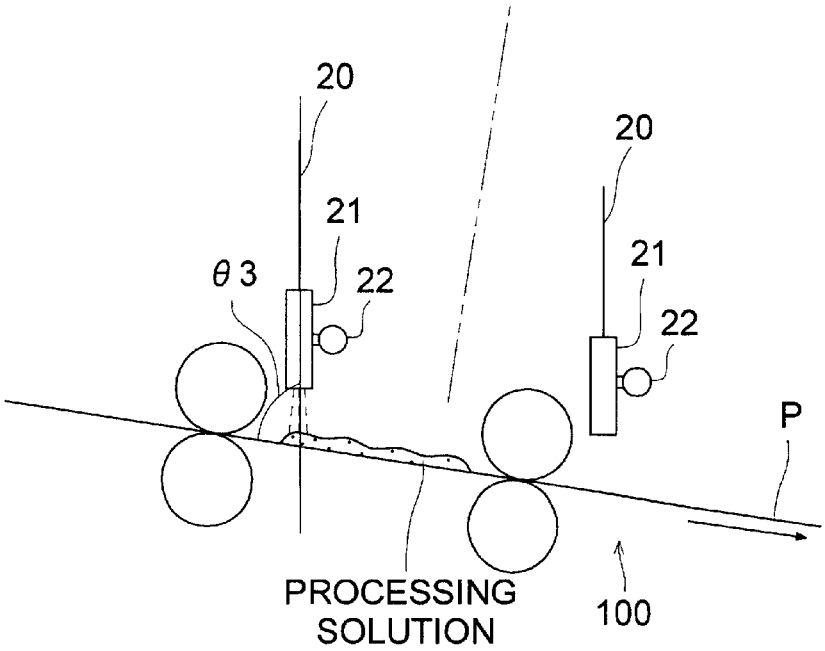

FIG. 15 is a diagram showing a processing solution coating means wherein a conveyance path through which a photosensitive material is conveyed to be inclined downward in its advancing direction and an angle of a processing solution jetted from a spray nozzle are tilted by a prescribed angle from and advancing direction of the photosensitive material.

Figure 16:
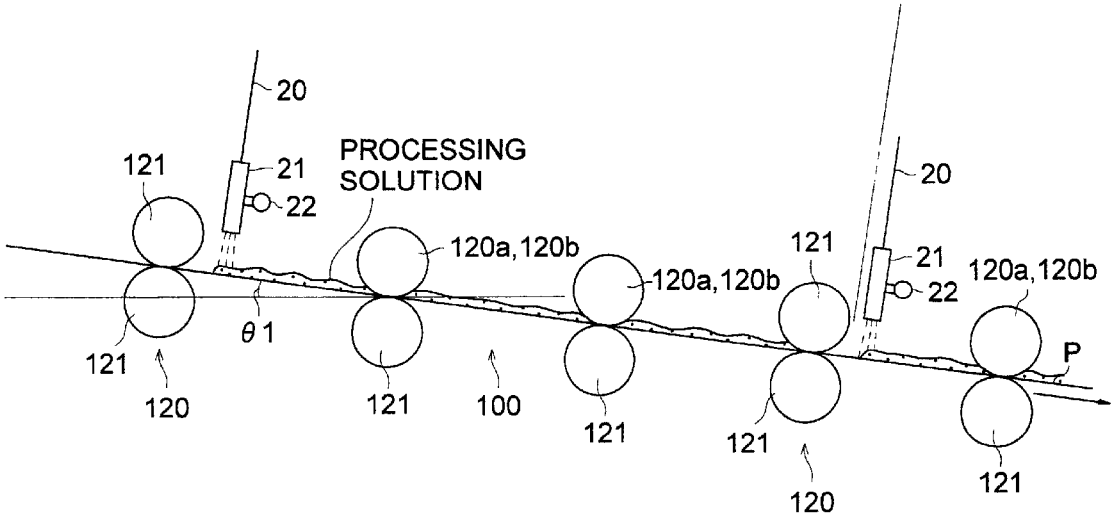

FIG. 16 is a diagram showing a conveyance means that conveys a photosensitive material.

Figure 17:
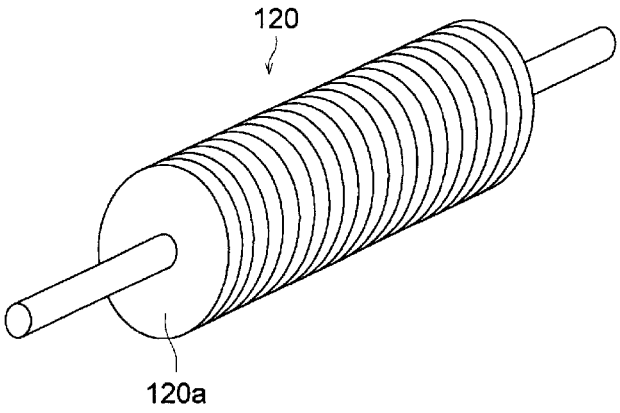

FIG. 17 is a perspective view of a comb-toothed roller that comes in contact with a photosensitive surface side of a photosensitive material.

Figure 18:
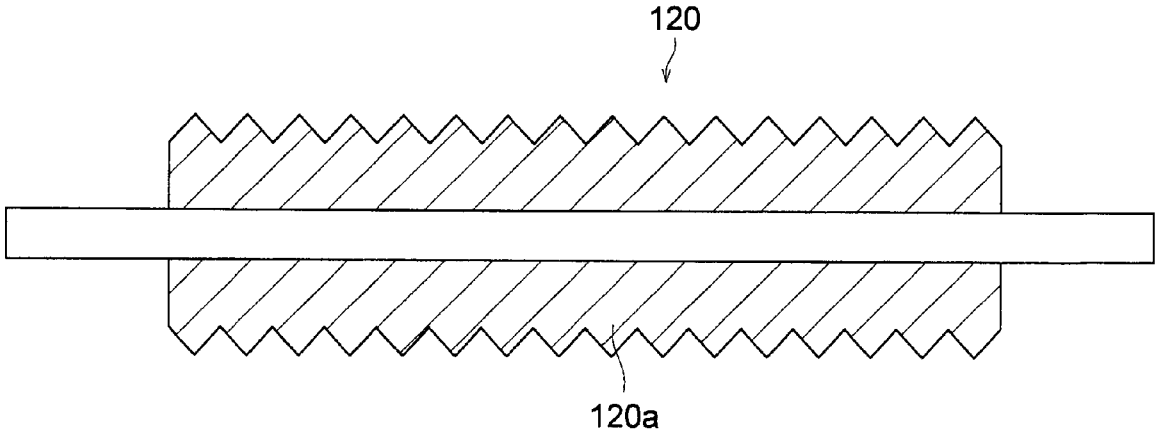

FIG. 18 is a sectional view of a comb-toothed roller that comes in contact with a photosensitive surface side of a photosensitive material.

Figure 19:
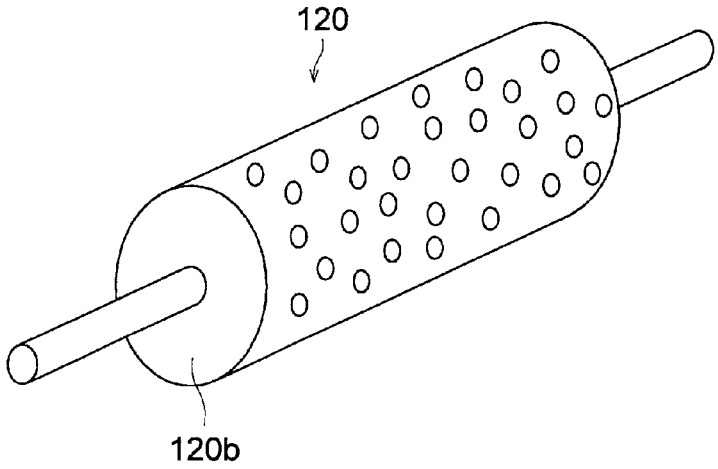

FIG. 19 is a perspective view of a wart roller that comes in contact with a photosensitive surface side of a photosensitive material.

Figure 20:
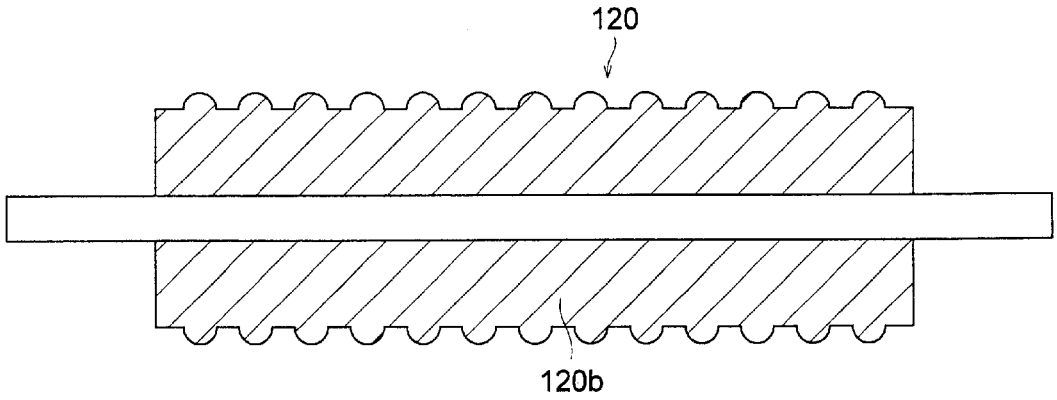

FIG. 20 is a sectional view of a wart roller that comes in contact with a photosensitive surface side of a photosensitive material.

Figure 21:
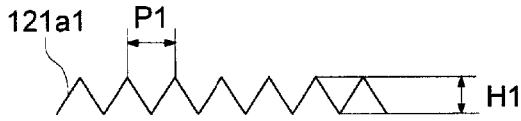
Figure 21:
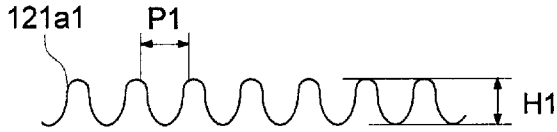
Figure 21:
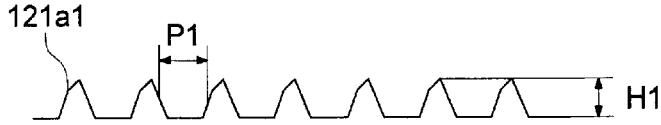
Figure 21:
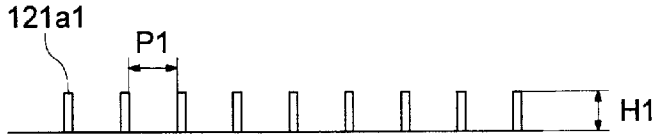

FIGS. 21(*a*) to 21(*d*) are sectional views showing a comb-toothed form of a comb-toothed roller that comes in contact with a photosensitive surface side of a photosensitive material.

Figure 22:
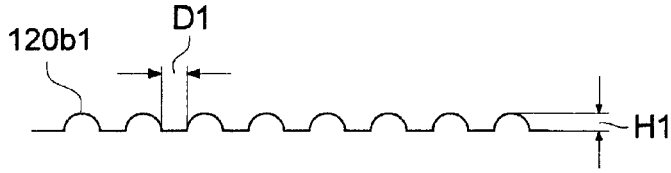
Figure 22:
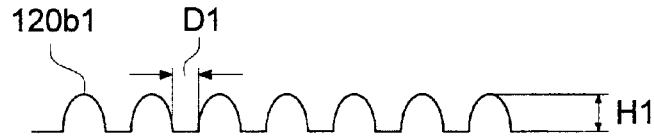

FIGS. 22(*a*) and 22(*b*) are sectional views showing a wart form of a wart rollers that come in contact with a photosensitive surface side of a photosensitive material.

Figure 23:
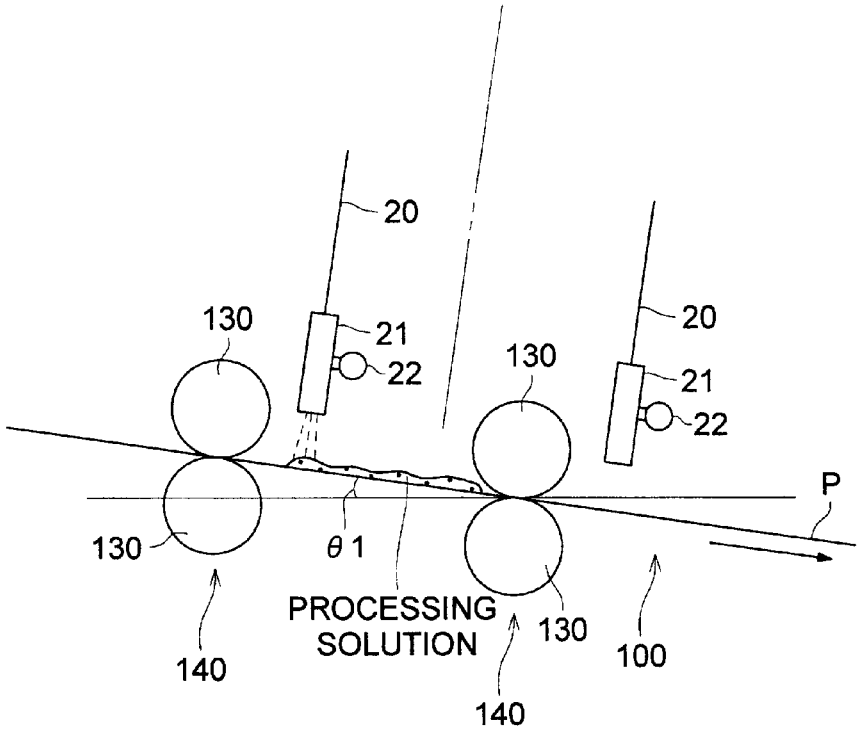

FIG. 23 is a diagram showing a flat roller of a conveying device.

Figure 24:
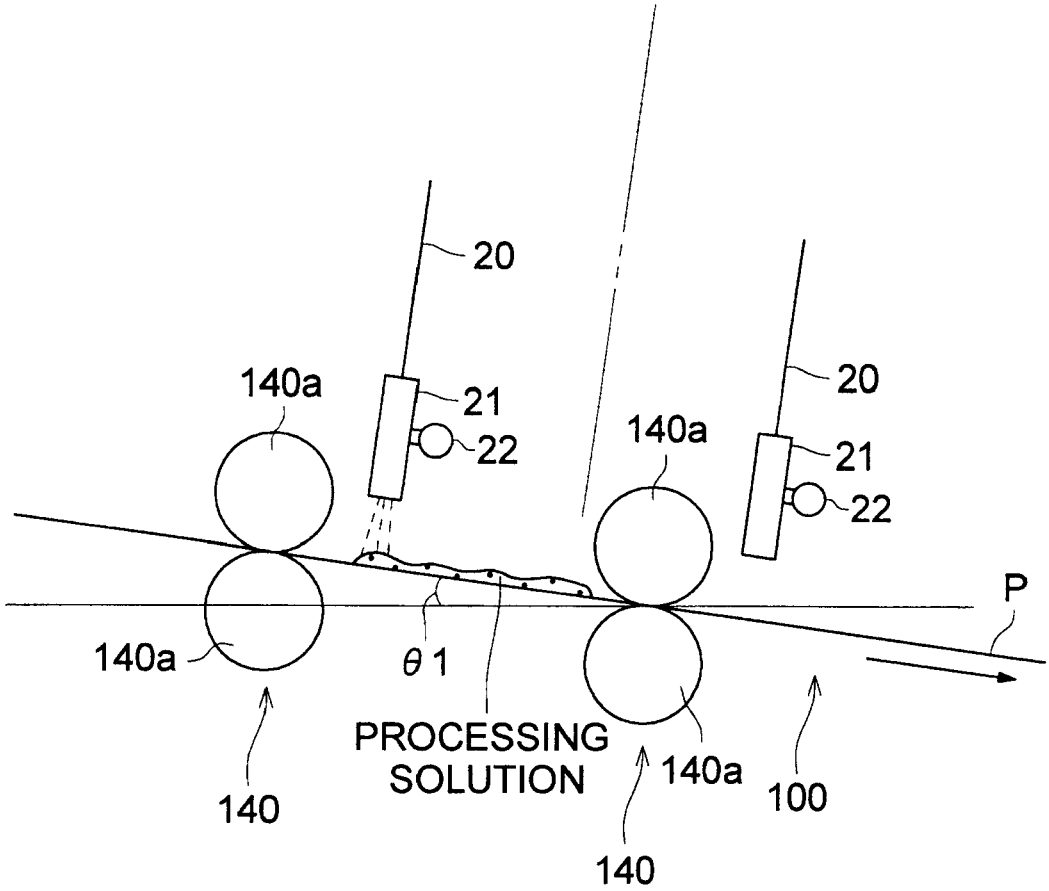

FIG. 24 is a diagram showing a hard roller of a conveying device.

DETAILED DESCRIPTION OF THE PRESENT INVENTION

The present invention will be explained in detail, referring to the following structures to which, however, the invention is not limited.

(Processing Solution-stocking Tank, Force Feeding Means, Processing Solution Supply Means)

The automatic processing apparatus for photosensitive materials is provided with a processing solution stocking tank in which a processing solution is reserved, a force feeding means that force-feeds a processing solution reserved in the processing solution stocking tank at a pressure which is almost constant, and a processing solution supply means which supplies a processing solution from the force feeding means to a processing solution coating means through an automatic opening and closing valve.

It is preferable that the force feeding means is composed of a feeding pump, for example, and at least a part of a path from the force feeding means to the automatic opening and closing valve of the processing solution supply means is composed of a flexible piping. It is constituted so that at least a part of a path from the force feeding means to the automatic opening and closing valve is a flexible piping, and a bend of the flexible piping is changed by a movement of the automatic opening and closing valve and a processing solution coating device. It is preferable that the processing solution supply means is provided with a processing solution heating means that heats a processing solution to a prescribed temperature.

(Processing Solution Coating Device, Moving Means)

An automatic processing apparatus for photosensitive materials of the invention is provided with a processing solution coating device that coats a processing solution on the exposed photosensitive material for processing.

The foregoing is of the structure wherein the processing solution coating device is made by a moving means to circulate through the prescribed movement path or to reciprocate so that a processing solution is coated in a line form on a photosensitive material at a speed of plural lines or more per second, while, the photosensitive material is moved relatively in the direction that is mostly perpendicular to the direction of the coated lines.

The processing solution coating device is of a system to supply a processing solution to the surface of a photosensitive material so that a thin layer in a small area may be formed, and it has a solution flow regulating section that allows a constant amount of solution to pass by receiving mostly constant solution pressure.

As a method to supply a processing solution, it is possible to use a method wherein a processing solution flows through the surface or the inside representing a solution flowing path in a coating medium such as a brush, a paint-brush, felt, a roller and a ball, and this coating medium comes in contact with a photosensitive material to coat, or a method wherein a spray nozzle is provided to be away from a photosensitive material and a processing solution is jetted from the spray nozzle to the photosensitive material through a gaseous phase to be coated.

When the processing solution coating device is a spray nozzle that is not in contact with a photosensitive material, it is constructed so that a solution flow regulating section is located at a tip portion of the spray nozzle and a processing solution is jetted to the photosensitive material through air to be coated.

There is no limitation for a spray nozzle in particular, but the spray nozzle jetting a processing solution in a form of 1–3 lines is preferable, and those jetting in a form of 4 lines or more are also acceptable. Further, those jetting in a form of a spray with one line are also acceptable.

With regard to a bore of a spray nozzle, a range of 50–500$\mu$ in terms of a diameter is preferable from the viewpoint of stable coating with less coating unevenness. When liquid pressure in the spray nozzle for jetting is low, it is difficult to coat rapidly, while, when it is too high, a problem of scattering of a processing solution sometimes happens, thus, a range of 5–300 Kpa is preferable. It is further preferable that liquid pressure for jetting is adjusted in accordance with the number of lines per second within a range of 5–300 Kpa.

It is preferable that a distance between a photosensitive material and a spray nozzle is established to be 30 mm or less, because coating is stabilized. it is preferable that an amount of processing solution to be supplied is within a range of 20–500 ml per 1 $m^2$ of a photosensitive material, because coating unevenness is caused when the amount is too small, and flowing unevenness is caused when the amount is too large. An amount of 50–300 ml per 1 $m^2$ of a photosensitive material is more preferable.

The moving means moves the processing solution coating device along the prescribed movement path, and this movement is in a form of circulation or reciprocation, and a processing solution is coated on a photosensitive material in a form of lines at a rate of not less than plural lines per second. By coating a processing solution on a photosensitive material in a form of lines at a rate of not less than plural lines per second, it is possible to coat a processing solution uniformly and stably at high speed without processing unevenness, and a rate of 6–50 lines per second is preferable, while, a rate of 10–20 lines per second is more preferable.

The photosensitive material is conveyed relatively in the direction that is mostly perpendicular to the direction of the coated lines. The photosensitive material is conveyed at a constant speed, or it is conveyed intermittently by a length shorter than a width of the coated line each time 1–3 lines are coated. It is possible to conduct line coating by moving the processing solution coating device, on a basis of circulation or reciprocation, in the direction that is mostly perpendicular to the direction for conveying a photosensitive material.

The coated line that is in a form of a straight line makes the structure to be simple and makes operation and coating to be easy, which is preferable, and a determination of a length of a coated line made in accordance with a width of a photosensitive material within a range of 10–200 mm is preferable.

In another embodiment of the invention, a plurality of processing solution coating devices each coating a processing solution on a photosensitive material are arranged in a form of a straight line in the direction mostly perpendicular to the direction for conveying the photosensitive material, and a processing solution is coated on the photosensitive material in a form of lines by a circulating movement or a reciprocating movement in the direction of the arrangement of the processing solution coating devices. It is constructed, in this case, so that at least a part of processing solution coated by adjoining processing solution coating devices is overlapped, and the photosensitive material is moved in the direction mostly perpendicular relatively to the line, and thereby a processing solution is coated entirely on the photosensitive material.

In the construction mentioned above, processing solutions coated on a photosensitive material from a plurality of processing solution coating devices are coated in a form of a line at intervals, and each interval in terms of time for each coated line which is at least 0.3 sec. or less is preferable, because jetted processing solutions are overlapped on the photosensitive material.

It is preferable that the number of circulating or reciprocating movements of the processing solution coating device per second is 1.5 times or more. A range of 3–25 times per second is more preferable because it is possible to coat rapidly and stably without scattering of a processing solution.

When a plurality of processing solution coating devices are provided, a distance between adjoining processing solution coating devices is preferably 10–100 mm. Further, it is preferable that a length of a line to be coated on a photosensitive material by a circulating or reciprocating movement of processing solution coating devices is in a range of 1–3 times the distance between adjoining processing solution coating devices. When the length of the coated line is too short, a processing solution cannot be coated uniformly because the lines coated by adjoining processing solution coating devices are not overlapped, and when the coated line is too long, it is sometimes impossible to coat uniformly because a difference in an amount of coated solution between the central portion and the edge portion of the photosensitive material is large. If a length of a line of a processing solution coated by each processing solution coating device is in a range of 1–3 times the distance between adjoining processing solution coating devices, it is possible to coat a processing solution uniformly and stably at high speed without unevenness.

When a plurality of spray nozzles are provided, it is preferable that plural spray nozzles are installed at regular intervals of 10–100 mm on a line in the direction that is mostly perpendicular to the direction for conveying a photosensitive material. In this case, it is preferable that the processing solution supply device is of the structure to be branched off to supply a processing solution to each spray nozzle, and that each spray nozzle is totally fixed and all of plural spray nozzles are reciprocated for the length that is 1–3 times the distance between spray nozzles in the direction mostly perpendicular to the direction for conveying a photosensitive material, to coat a processing solution.

(Automatic Opening and Closing Valve)

An automatic opening and closing valve is installed on a processing solution supplying means that is provided between a force feeding means and a processing solution coating device, and it is opened or closed depending on a width of a photosensitive material to be processed to supply a processing solution for coating to a processing solution coating device that is necessary for processing a photosensitive material.

When the automatic opening and closing valve is arranged to be installed in the vicinity of the processing solution coating device to move together with the processing solution coating device when it moves, response for stopping the coating of processing solution when the automatic opening and closing valve is closed and response for starting the coating of processing solution when the automatic opening and closing valve is opened are improved, and stable coating processing without processing unevenness is made possible, which is preferable.

When coating a processing solution on a photosensitive material, the control to open and close an automatic opening and closing valve plural times per second makes it possible to control an amount of coated processing solution, and makes stable coating without processing unevenness to be possible, which is preferable.

An electromagnetic valve, for example, may be used as an automatic opening and closing valve. The electromagnetic valve has therein a column having an outlet and an inlet for a processing solution, a valve part housing a magnet isolated from an inner wall in the column, and an electromagnetic induction section located outside the column, and is constructed to be in the state where the valve part closes the outlet or the inlet of the column or to be in the state of communication where the valve part does not close the outlet or the inlet of the column, depending on turning on or turning off of energizing of the electromagnetic induction section. It is preferable that the electromagnetic valve automatically senses a width of a photosensitive material and adjusts turning on and turning off for the electromagnetic induction section. The electromagnetic valve of this type can control an amount of coated processing solution in the simple structure, and makes stable coating processing without processing unevenness to be possible, which is preferable.

(Heating Means)

It is preferable to provide a heating means to heat a photosensitive material and/or a heating means to heat a processing solution to be coated by the automatic processing apparatus to photosensitive materials. As a heating means, there are given methods to use a heating drum, a heating belt, a drier, infrared rays or high-frequency electromagnetic waves. A photosensitive material may be heated at any time, before or after a processing solution is supplied to the photosensitive material, but from the viewpoint of rapid processing, it is preferably heated before a processing solution is supplied to it. The temperature of the heated photosensitive material which is 35° C. or more is preferable, and the temperature of 40° C. or more is more preferable from the viewpoint of rapid processing. From the heat resistance of the photosensitive material, 100° C. or less is preferable, and 80° C. or less is more preferable. To prevent an adverse effect on an emulsion side of a photosensitive material to be processed, it is preferable to heat on the surface of a photosensitive material opposite to the emulsion side.

(Conveyance Path)

The automatic processing apparatus for photosensitive materials of the invention is provided with a conveyance path through which a photosensitive material is conveyed to be inclined downward in the advancing direction, and the conveyance path makes a photosensitive material to be inclined within a range of 2–200 to convey it, thereby, a processing solution is coated in a form of a line on the inclined portion of the photosensitive material conveyed to be inclined downward in the advancing direction, thus, a processing solution does not flow back in the direction opposite to the advancing direction of the photosensitive material, resulting in uniform finishing without processing unevenness.

Further, it is preferable that a direction of the processing solution jetted from a spray nozzle through a gaseous phase is tilted from an advancing direction of the photosensitive material by a prescribed angle. By the structure, the processing solution is prevented from flowing back in the direction opposite to the advancing direction of the photosensitive material, and no processing unevenness is caused, resulting in uniform finishing, because a direction of the processing solution jetted from a spray nozzle through a gaseous phase is tilted from an advancing direction of the photosensitive material by a prescribed angle.

It is preferable that a direction of a processing solution jetted from a spray nozzle is inclined by a range of 70–88° from the advancing direction of a photosensitive material. Spray from the spray nozzle is in a vertical and downward direction, and when forming an angle by conveying a photosensitive material while it is inclined, it is possible to obtain the above-mentioned arrangement with a simple structure.

(Conveying Device)

The automatic processing apparatus for photosensitive materials of the invention is provided with a conveyance device for moving a photosensitive material, and it is preferable that the conveyance device conveys the photosensitive material by bringing a comb-toothed roller or a wart roller into contact with the photosensitive side of the photosensitive material. When the automatic processing apparatus for photosensitive materials of the invention has a plurality of processing solution coating steps, it is necessary to convey for coating a processing solution for the succeeding step after coating the first processing solution on the photosensitive side. In this case, when the comb-toothed roller or the wart roller is brought into contact with the photosensitive side of the photosensitive material, no fluctuation (processing unevenness) in processing property is caused, resulting in sure conveyance, which is preferable.

It is preferable that the reverse side of the photosensitive material is subjected to conveyance by paired nip rollers wherein a flat roller is arranged in place of the comb-toothed roller or the wart roller.

It is further preferable that a pitch of crests of comb-teeth is in a range of 1–5 mm and a depth of a root of a comb-tooth is in a range of 0.3–5 mm.

Further, it is preferable that a distance between adjoining warts is in a range of 1–5 mm and a height of a wart is in a range of 0.3–5 mm.

When the processing step is composed of a plurality of steps, a conveying device immediately before coating a processing solution for the succeeding step after coating the first processing solution is represented by squeeze nip paired rollers in the form of a pair of flat rollers, and thereby, processing unevenness can be prevented by coating a processing solution for the succeeding step after removing the first processing solution by squeezing it, which is preferable.

It is preferable that the conveying device used in the invention is a hard roller.

Further, it is preferable that the hard roller is a pair of nip rollers composed of a comb-toothed roller and a flat roller.

When a photosensitive material processed by the automatic processing apparatus for photosensitive materials of the invention is a silver halide color photosensitive material, and all rollers coming in contact with the chromogenic developer are hard rollers, processing unevenness in the form of a spot in a cyanic color can be prevented, which is preferable.

As a hard roller, there is given a roller wherein plastic material such as a phenol resin, a polyphenyleneoxide resin, a polyphenylenesulfide resin, a fluorine-contained resin or an olefin resin, or metallic material such as stainless steel or titanium steel is used on the portion that comes in contact with a photosensitive surface, to which, however, the invention is not limited.

(Processing Solution Removing Device)

It is preferable that the automatic processing apparatus for photosensitive materials of the invention is provided with a processing solution removing device which removes a processing solution with paired nip rollers under a situation that a photosensitive material is inclined downward in its advancing direction immediately before entering the processing in the succeeding step after coating the processing solution, thereby, the processing solution removing device prevents a processing solution from entering the processing in the succeeding step, and from flowing back in the direction opposite to the advancing direction of the photosensitive material.

(Processing Step)

Though the automatic processing apparatus for photosensitive materials of the invention can be used in any step provided that the step is a processing step wherein a photosensitive material is processed by a processing solution, it is preferable that the automatic processing apparatus is used for a processing step where dyes are generated or oxidation reaction takes place, such as a developing step, a chromogenic development step and a bleaching step, rather than for a processing step to remove useless matters such as a fixing step and a stabilizing step. Among these processing steps, the developing step and the chromogenic development step are more preferable, and the chromogenic development step is especially preferable from the viewpoint of storage stability relating to occurrence of tar caused by oxidation of developing agent.

(Processing Solution)

A processing solution used in the invention includes not only an ordinary processing solution but also liquid which cannot complete processing reaction by itself, and it means all solutions each containing a component capable of contributing to processing of photosensitive materials, and mere water can be included.

In the automatic processing apparatus for photosensitive materials of the invention, a processing solution that contains all components needed for the processing (for example, developing, fixing and bleaching) may be supplied at a time in one processing step or it is possible to make necessary components to be contained in plural solutions to be supplied separately. When dividing into plural solutions to supply separately, the time required for all solutions necessary for the one processing to be supplied which is the shortest possible period of time is preferable on the point of rapid processing, and the necessary time within 5 sec., for example, or within 1 sec. is preferable.

It is preferable that surface tension o a processing solution used in the invention is 25–50 dyne/cm, and more preferable is 30–45 dyne/cm. To obtain this surface tension, surface active agents are preferably added in an appropriate way.

In the automatic processing apparatus for photosensitive materials of the invention, it is preferable that solute concentration of a processing solution is 0.2% by weight or more. The solute concentration of 4–20% by weight is more preferable, and that of 1.0–10% by weight is especially preferable.

When supplying a plurality of processing solutions to a photosensitive material, it is also possible to provide a plurality of processing solution coating devices to supply a processing solution to a photosensitive material from the first processing solution coating device, and then, to supply a processing solution from the second processing solution coating device.

(Chromogenic Development Processing)

The automatic processing apparatus for photosensitive materials of the invention is preferably applied to a development-processing step, and especially to a chromogenic development processing step, and a chromogenic developer in the invention also includes liquid that is unable to complete chromogenic development reaction by itself. For example, liquid that contains only chromogenic development agent and preserving agent, liquid that contains only surface active agents and mere water are included.

Though a processing solution capable of completing chromogenic development reaction by itself may be supplied to an emulsion side of a photosensitive material, it is also possible to make components necessary for chromogenic development processing reaction to be contained in separate plural processing solutions to supply them separately so that they are mixed on the emulsion side of the photosensitive material to conduct chromogenic development processing. Chromogenic development processing wherein necessary components are contained in plural processing solutions which are supplied separately can make concentration of components to be high, and it is preferable from the point of view of rapid processing.

Processing time of 2 sec. or more especially 4 sec. or more for chromogenic development processing step is preferable for completing chromogenic development processing reaction stably, and processing time of 30 sec. or less, further, 20 sec. or less, especially 15 sec. or less is preferable from the viewpoint of deterioration of a chromogenic development solution and of drying of a chromogenic development solution.

Processing time for chromogenic development processing step in this case means a period of time from the moment when chromogenic developer is supplied first to an emulsion side of a photosensitive material to the moment when a processing solution for the succeeding step (for example, a bleaching step, a bleach-fixing step) is supplied or when the photosensitive material is dipped in the processing solution for the succeeding step.

(Photosensitive Material)

As preferable examples of a photosensitive material processed by the automatic processing apparatus for photosensitive materials of the invention, there are given a silver halide color photographic photosensitive material and a silver halide monochromatic photographic photosensitive material both containing silver bromoiodide or silver bromide. As more preferable examples, there are given a silver halide color photographic photosensitive material and a silver halide monochromatic photographic photosensitive material both containing an emulsion of silver chloride. Further, it is preferable to provide at least one emulsion layer containing a silver halide emulsion composed of 90 mol % or more of silver chloride. A silver halide emulsion composed of 95–100 mol % of silver chloride is more preferable, and a silver halide emulsion composed of 98–100 mol % of silver chloride is most preferable, from the point of view of rapid processing.

Embodiments of the automatic processing apparatus for photosensitive materials of the invention will be explained in detail as follows, referring to the drawings. These embodiments show concrete examples of the invention, and do not limit definitions of terminology of the invention. Further, decisive descriptions which may appear in the embodiment show preferable examples as an embodiment, and do not limit the invention and definitions of terminology.

Figure 1:
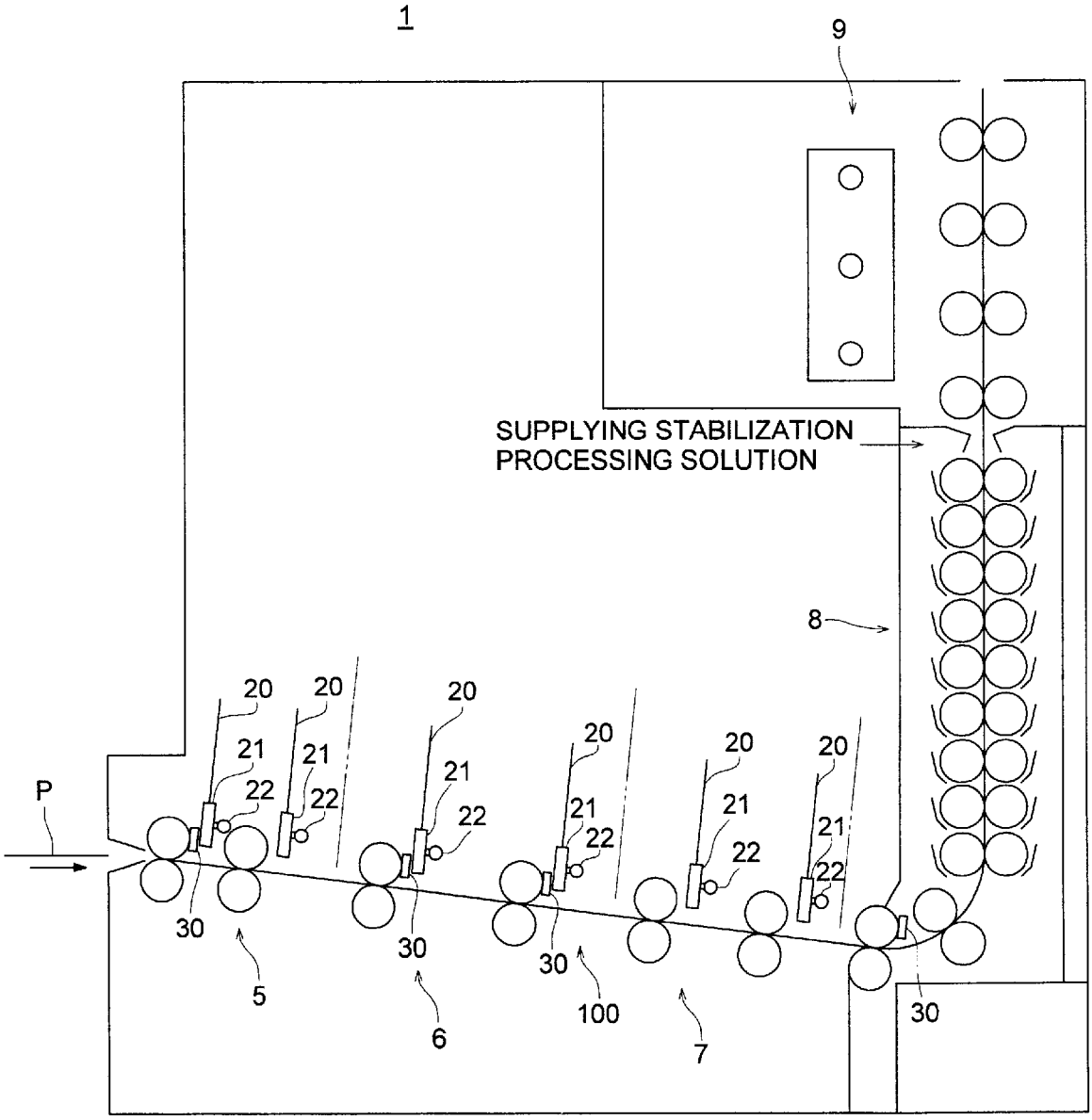
FIG. 1 is a diagram showing the schematic structure of an automatic processing apparatus for photosensitive materials.

FIG. 1 is a diagram showing the schematic construction of an automatic processing apparatus for photosensitive materials. In automatic processing apparatus for photosensitive materials 1, developing section 5, bleaching section 6 and fixing section 7 are arranged in the horizontal direction, and stabilizing section 8 and drying section 9 are arranged in the vertical direction. Photosensitive material P fed out of a paper magazine is cut to a prescribed length by a cutter in an unillustrated sheet cutting section, then, it is exposed to light by an unillustrated exposure section so that a latent image is formed thereon, and is supplied to the developing section 5.

On each of the developing section 5, bleaching section 6 and fixing section 7, there are installed processing supply means 20, processing solution coating device 21 and moving means 22. In the developing section 5, a developing solution is coated on photosensitive material P for the developing processing, while, in the bleaching section 6, a bleaching solution is coated on photosensitive material P for the bleaching processing, and, in the fixing section 7, a fixing solution is coated for the fixing processing. The photosensitive material P is further fed to the stabilizing section where a stabilizing solution is supplied, thus, the photosensitive material P processed by each processing solution as stated above is dried in the drying section 9 to be ejected.

On each of the developing section 5, bleaching section 6 and fixing section 7 and stabilizing section 8, there is provided heating means 30 which heats a photosensitive material, and thereby the reaction by the coated processing solution is accelerated, rapid processing at high temperature is made possible, and a processing solution can be coated uniformly at high speed, resulting in stable coating without processing unevenness. A heating means to heat a processing solution to be coated may also be provided.

Figure 2:
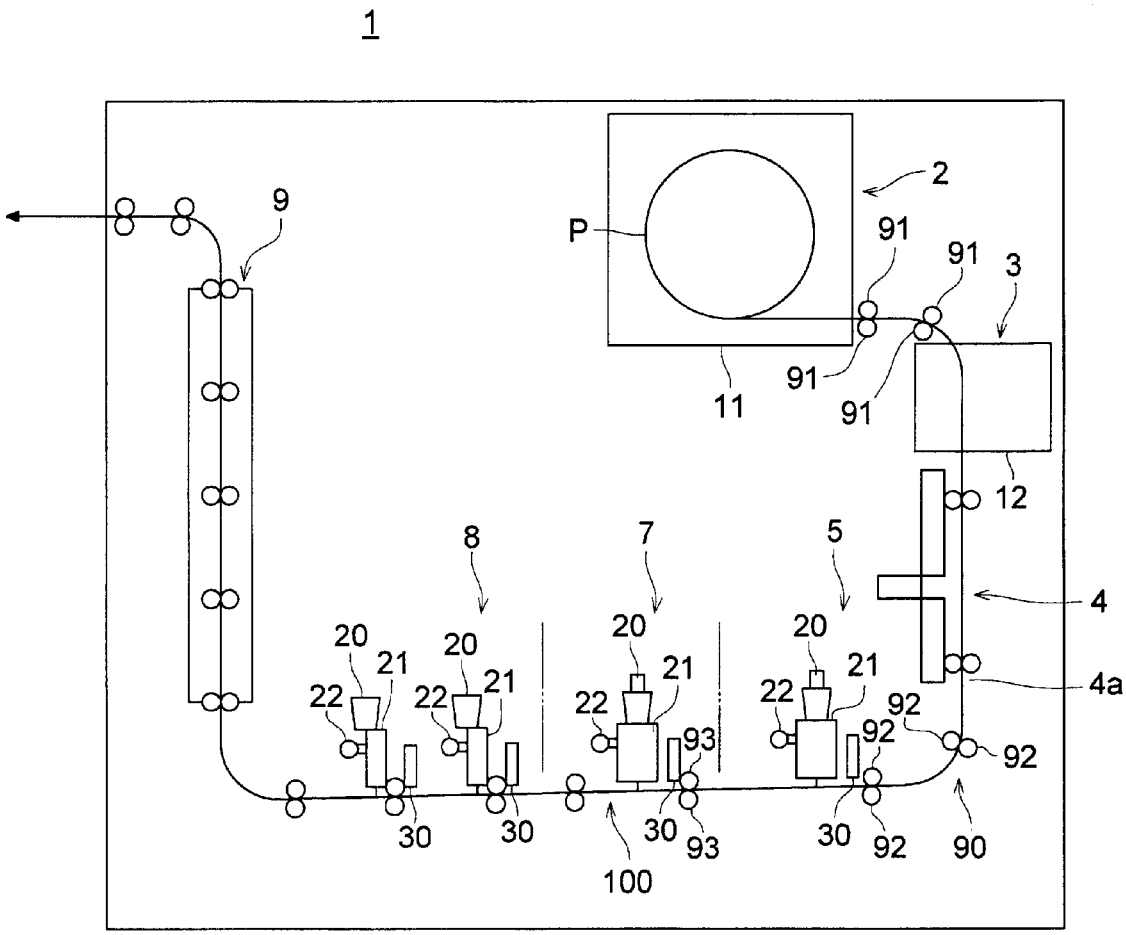
FIG. 2 is a diagram showing the schematic structure of another embodiment of the automatic processing apparatus for photosensitive materials.

FIG. 2 is a diagram showing the schematic construction of another embodiment of the automatic processing apparatus for photosensitive materials. In automatic processing apparatus for photosensitive materials 1, there are arranged photosensitive material loading section 2, sheet cutting section 3, exposure section 4, developing section 5, fixing section 7, stabilizing section 8 and drying section 9.

The developing section 5, fixing section 7 and stabilizing section 8 are arranged in the lower portion, the photosensitive material loading section 2 is arranged at the upper portion, and the sheet cutting section 3 and the drying section 9 are arranged respectively on both sides, so that the apparatus is of the compact construction.

In the photosensitive material loading section 2, there is loaded paper magazine 11 in which photosensitive material P is housed. Photosensitive material P fed out of the paper magazine 11 is cut to a prescribed length by cutter 12 in the sheet cutting section 3.

The photosensitive material P is fed to the exposure section 4 where a latent image is formed on the photosensitive material P through exposure. On the developing section 5, bleaching section 6 and fixing section 7, there are installed processing solution supply means 20, processing solution coating device 21 and moving means 22. In the developing section 5, a developing solution is coated on photosensitive material P for the developing processing, while, in the bleaching section 6, a bleaching solution is coated on photosensitive material P for the bleaching processing, and, in the fixing section 7, a fixing solution is coated for the fixing processing. The photosensitive material P is further fed to the stabilizing section where a stabilizing solution is supplied, thus, the photosensitive material P processed by each processing solution as stated above is dried in the drying section 9 to be ejected.

On each of the developing section 5, fixing section 7 and stabilizing section 8, there is provided heating means 30 which heats a photosensitive material, and thereby the reaction by the coated processing solution is accelerated, rapid processing at high temperature is made possible, and a processing solution can be coated uniformly at high speed, resulting in stable coating without processing unevenness. A heating means to heat a processing solution to be coated may also be provided.

Next, processing solution supply means 20, processing solution coating device 21 and moving means 22 provided in FIG. 1 and FIG. 2 will be explained in detail.

In automatic processing apparatus for photosensitive materials 1, there are provided processing solution coating means 21 that coats a processing solution on a photosensitive material, processing solution supply means 20 that supplies a processing solution to the processing solution coating device 21, and moving means 22 that moves the processing solution coating device 21 along the prescribed moving direction.

Dissolving unit 15 provided in the automatic processing apparatus for photosensitive materials 1 has processing solution stock tank 150 in which a processing solution is reserved. The processing solution stock tank 150 is connected to supply pump 230 that constitutes force feeding means 23 which feeds forcibly, under the mostly constant pressure, a processing solution housed in the processing solution stock tank 150.

With regard to the processing solution supply means 20, a processing solution coming from the supply pump 230 advances to processing solution coating means 21 through automatic opening and closing valve 24. The automatic opening and closing valve 24 is provided in the vicinity of the processing solution coating device 21, and thereby, response for stopping the coating of processing solution when the automatic opening and closing valve is closed and response for starting the coating of processing solution when the automatic opening and closing valve is opened are improved, and stable coating processing without processing unevenness is made possible.

With respect to the processing solution supply means 20, at least a part of the path from the supply pump 230 to the automatic opening and closing valve 24 is made to be flexible piping 231 which is of the structure wherein the bending of the flexible piping section is fluctuated by the movement of the automatic opening and closing valve 24 and the processing solution coating device 21. By virtue of the fluctuation of the bending of the flexible piping section caused by the movement of the automatic opening and closing valve 24 and the processing solution coating device 21, the processing solution coating device 21 can move smoothly, which makes stable coating without processing unevenness to be possible.

The processing solution coating device 21 is one for coating a processing solution on a photosensitive material P, and it has a liquid flow regulating section which receives liquid pressure that is mostly constant and makes a constant liquid flow to pass through. The processing solution coating device 21 is spray nozzle 210 which is not in contact with a photosensitive material P, and the liquid flow regulating section is a tip portion of the spray nozzle 210 which is structured to jet a processing solution to a photosensitive material P through a gaseous phase.

Figure 4:
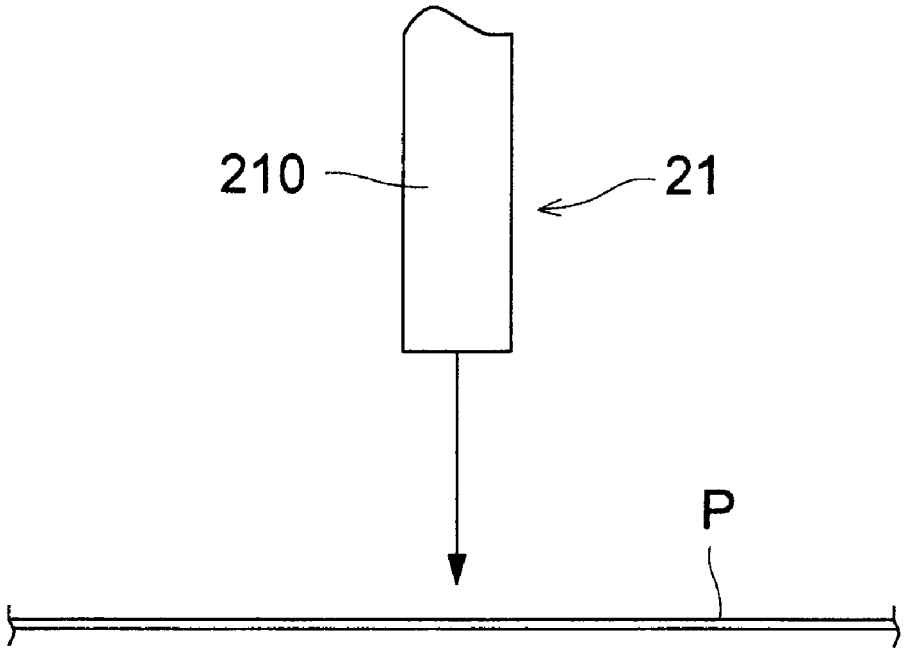
FIG. 4 is a diagram showing the structure of a processing solution-coating device.

The processing solution coating device 21 of the present embodiment is of a system to supply a processing solution so that the processing solution may form a thin layer of a small area on the surface of photosensitive material P. As a method to supply a processing solution, there is used a method to coat a processing solution by jetting through a gaseous phase from spray nozzle 210 provided to be away from photosensitive material P, as shown in FIG. 4. It is also possible to use a method wherein a processing solution flows through the surface or the inside representing a solution flowing path in a coating medium such as a brush, a paint-brush, felt, a roller and a ball, and this coating medium comes in contact with a photosensitive material for coating.

With regard to spray nozzle 210, there is no limitation for the number of lines in particular as shown in FIGS. 5(*a*)–5 (*d*), but the spray nozzle jetting a processing solution in a form of 1–3 lines is preferable, and those jetting in a form of 4 lines or more are also acceptable. Further, those jetting in a form of a spray with one line are also acceptable as shown in FIG. 5 (*e*).

As shown in FIG. 6, a range of 50–500 $\mu$m in terms of a diameter of the spray nozzle 210 is preferable because it is possible to coat stably with less coating unevenness. When liquid pressure in spray nozzle 210 for jetting is low, it is impossible to coat rapidly, while, when it is too high, a problem of scattering of a processing solution sometimes happens, thus, a range of 5–300 Kpa is preferable. It is further preferable that liquid pressure for jetting is adjusted in accordance with the number of lines per second within a range of 5–300 Kpa.

It is preferable that distance L between photosensitive material P and spray nozzle 210 is set to 30 mm or less as shown in FIG. 7, because coating is stabilized.

Coating line R made by spray nozzle 210 is a straight line whose length is in a range of 10–200 mm as shown in FIG. 8, and it is determined depending on a width of photosensitive material P. It is preferable that the coating line R is a straight line, because it provides a simple structure, easy operation and excellent coating property.

As shown in FIG. 9, it is preferable that an amount of a processing solution to be supplied is within a range of 20–500 ml per area E of 1 $m^2$ of a photosensitive material, and when an amount of a processing solution to be supplied is too small, coating unevenness is caused, while when it is too large, flowing unevenness is caused, and an amount of 50–300 ml per area E of 1 $m^2$ of a photosensitive material is more preferable.

Figure 3:
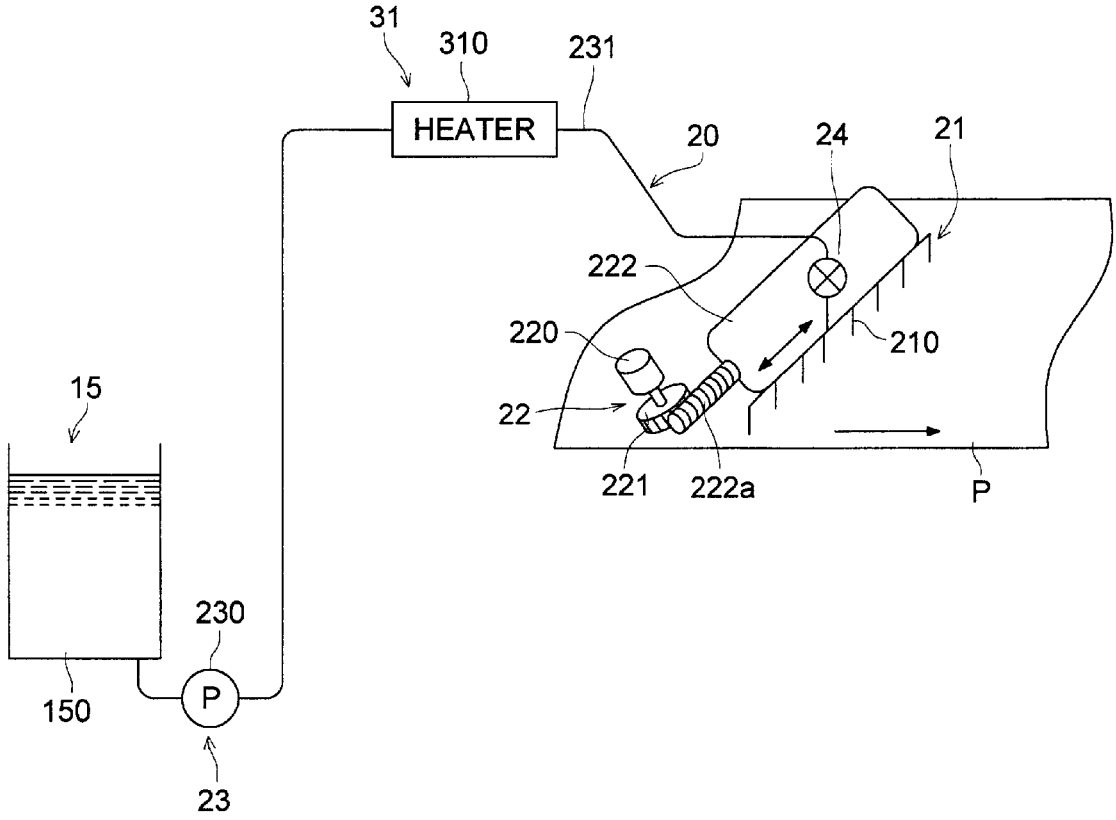
FIG. 3 is a diagram showing the structure of a processing coating section for a processing solution.

Moving means 22 is one for moving processing solution coating device 21 along a prescribed moving direction, and it is composed of driving motor 220, driving gear 221 and moving member 222 having moving gear 222*a* as shown in FIG. 3. The driving gear 221 is rotated regularly and inversely by the driving motor 220, and hereby, the moving member 222 reciprocates. On the moving member 222, there is attached spray nozzle 210 of processing solution coating device 21.

The processing solution coating device 21 is moved, through reciprocating movement which is taken in the present embodiment or circulating movement, by the moving means 22 along a prescribed moving direction so that a processing solution is coated on photosensitive material P in a form of lines at a rate of three lines or more per second. By coating a processing solution on a photosensitive material in a form of lines at a rate of three lines or more per second, it is possible to coat stably without processing unevenness, and a range of 6–50 lines per second is preferable, and a range of 10–20 lines per second is more preferable.

Photosensitive material P is arranged to be moved relatively in the direction that is mostly perpendicular to coating line R as shown in FIG. 10, and the photosensitive material P is conveyed at a constant speed, or the photosensitive material P is moved intermittently by a length that is shorter than a width of a coated line of a processing solution once every 1–3 lines.

Though processing solution supply means 20 and moving means 22 are constructed in the same way as in the aforesaid embodiment, as shown in FIG. 11, in automatic processing apparatus for photosensitive materials 1 in another embodiment of the invention, the processing machine is constructed so that a plurality of processing solution coating device 21 for coating a processing solution on a photosensitive material are provided, and circulating or reciprocating movements of a plurality of processing solution coating device 21 make a processing solution to be coated in a form of lines along one line on the photosensitive material, and processing solutions from at least two adjoining processing solution coating device 21 are partially overlapped on photosensitive material P which is moved relatively in the direction that is mostly perpendicular to the direction of the form of lines.

In the construction mentioned above, processing solutions coated on a photosensitive material from a plurality of processing solution coating device 21 are coated in a form of a line at intervals, and each interval in terms of time for each coated line which is at least 0.3 sec. or less is preferable, because jetted processing solutions are overlapped on the photosensitive material.

It is preferable that the number of circulating or reciprocating movements per second is 1.5 times or more, and a movement is carried out many times, while, a range of 3–25 times per second makes it possible to coat rapidly, and it makes stable finish without scattering of a processing solution possible.

It is preferable that distance W1 on photosensitive material P between processing solutions from at least processing solution coating device 21 adjoining on the photosensitive material is 10–100 mm. It is further preferable that length W2 of a processing solution line to be coated on photosensitive material P by a circulating or reciprocating movement of processing solution coating device 21 is in a range of 1–3 times the distance 10–100 mm on photosensitive material P. When the processing solution line length W2 is too short, processing solution lines are not partially overlapped on photosensitive material P, making it impossible to coat a processing solution uniformly, while, when the processing solution line length W2 is too long, a difference in an amount of coated solution between the central portion and the edge portion is large, and if the central portion only is used for coating, an amount of solutions to be scrapped is increased. If the length W2 of the processing solution line coated in a form of lines on photosensitive material P is in a range of 1–3 times the distance on the photosensitive material P, it is possible to coat a processing solution uniformly and stably at high speed without processing unevenness.

In sheet cutting section 3 provided on the automatic processing apparatus for photosensitive materials of the present embodiment, a photosensitive material is cut to a prescribed length by cutter 12 as shown in FIG. 2, and photosensitive material P obtained through cutting is conveyed to exposure section 4 by conveying device 90 which is composed of paired nip rollers 91. The exposure section 4 is of the structure wherein photosensitive material P is subjected to digital exposure in a form of lines in the direction perpendicular to the conveyance direction for the photosensitive material while the photosensitive material P is being conveyed.

The automatic processing apparatus for photosensitive materials of the present embodiment has therein conveyance path 100 through which photosensitive material P is conveyed to be inclined downward in its advancing direction as shown in FIGS. 1 and 2. The conveyance path 100 conveys a photosensitive material in a way that the photosensitive material is inclined by angle θ ranging from 2° to 20° as shown in FIG. 12.

The processing solution coating device 21 is of a system to coat a processing solution by jetting it from spray nozzle 210 to photosensitive material P through a gaseous phase, and when a processing solution is coated in a form of lines on an inclined portion of photosensitive material P conveyed to be inclined downward in its advancing direction, the processing solution flows in the advancing direction of the photosensitive material P without flowing back in the opposite direction, resulting in uniform finish without processing unevenness.

With regard to the conveyance path 100, if the inclination of the photosensitive material is smaller than 2°, there is a possibility that a processing solution flows back in the direction opposite to the advancing direction of the photosensitive material, while, if the inclination is greater than 20°, there is a possibility that a processing solution flows fast in the advancing direction of the photosensitive material. When the photosensitive material is conveyed to be inclined in a range of 2–20°, the processing solution does not flow back in the opposite direction, and flows fast in the advancing direction, resulting in uniform finish without processing unevenness.

The automatic processing apparatus for photosensitive materials of the present embodiment is provided, as shown in FIG. 13, with conveyance path 100 through which the photosensitive material P is conveyed to be inclined downward in its advancing direction, processing solution coating device 21 that coats a processing solution in a form of lines on photosensitive material P which is being conveyed, and with processing solution removing device 101 that removes a processing solution with paired nip rollers 101*a* from a photosensitive material inclined downward in its advancing direction, immediately before entering processing of the succeeding step after the processing solution has been coated.

The processing solution removing device 101 is arranged immediately before entering processing of the succeeding step after the processing solution has been coated, for example in the embodiment shown in FIG. 1, immediately before entering bleaching section 6 from developing section 5, immediately before entering fixing section 7 from bleaching section 6, and immediately before entering stabilizing section 8 from fixing section 7. In the embodiment shown in FIG. 2, the processing solution removing device 101 is arranged immediately before entering fixing section 7 from bleaching section 6, and immediately before entering stabilizing section 8 from fixing section 7.

By removing a processing solution with paired nip rollers 101*a* from the photosensitive material inclined downward in its advancing direction, the processing solution neither enters the processing of the succeeding step nor flows back in the direction opposite to the advancing direction of the photosensitive material, resulting in uniform finishing.

With regard to the conveyance path 100, photosensitive material P is inclined by angle θ1 ranging from 2° to 20° to be conveyed, and thereby, a processing solution does not flow back in the direction opposite to the advancing direction of the photosensitive material P, and flows fast in the advancing direction, to be removed surely by paired nip rollers 101*a* on the upper side as shown in FIG. 13, resulting in uniform finish without processing unevenness.

The automatic processing apparatus for photosensitive materials of the present embodiment is provided, as shown in FIG. 14, with conveying device 101 that conveys a photosensitive material, and processing solution coating device 21 that coats a processing solution by jetting it to the photosensitive material which is being conveyed from spray nozzle 210 through a gaseous phase. The conveying device 110 is composed of paired nip rollers 110*a*, and it conveys a photosensitive material in the horizontal direction, while, with regard to the processing solution coating device 21, the direction of a processing solution jetted from spray nozzle 210 through a gaseous phase is tilted by prescribed angle θ2 from the advancing direction of photosensitive material P.

The direction of a processing solution jetted from spray nozzle 210 is tilted from the advancing direction of photosensitive material P by angle θ2 in a range of 70–88°. When an inclination of this angle θ2 of the processing solution jetted from the spray nozzle 210 is smaller than 70°, there is a risk that the processing solution flows fast in the advancing direction of the photosensitive material, while, when the inclination is greater than 88°, there is a risk that the processing solution flows back in the direction opposite to the advancing direction of the photosensitive material. When the photosensitive material is conveyed to be inclined in a range of 70–88°, the processing solution does not flow back in the opposite direction, and flows fast in the advancing direction, resulting in uniform finish without processing unevenness.

As shown in FIG. 15, jetting from spray nozzle 210 is downward vertically, and photosensitive material P is tilted to be conveyed as shown in FIG. 15, and thereby, angle θ3 is formed. Thus, an angle can be formed by a simple structure when jetting from spray nozzle 210 is downward vertically and a photosensitive material is tilted to be conveyed, as stated above, and a processing solution jetted from spray nozzle 210 does not flow back in the direction opposite to the advancing direction of the photosensitive material and it flows fast in the advancing direction, resulting in uniform finishing without processing unevenness.

In the automatic processing apparatus for photosensitive materials of the present embodiment, conveying device 120 that conveys a photosensitive material is composed of comb-toothed roller 120*a* that is shown in FIGS. 17 and 18 and comes in contact with a photosensitive surface of photosensitive material P or of wart roller 120*b* shown in FIGS. 19 and 20, as shown in FIG. 16.

In the present embodiment, flat roller 121 is used in the position which is just ahead of spray nozzle 210 that coats chromogenic developer, because no processing solution is coated on photosensitive material P in that position. However, it is also possible to use comb-toothed roller 120*a* or wart roller 120*b* in place of the flat roller.

Since chromogenic developer is coated on photosensitive material P in the position which is just ahead of spray nozzle 210 that coats beach and fix, the chromogenic developer is removed by paired nip rollers employing flat roller 121, and bleach and fix is coated by spray nozzle 210.

With regard to conveyance of photosensitive material P on which a processing solution such as chromogenic developer or bleach and fix is coated, the conveyance is conducted by paired nip rollers composed of flat roller 121 and comb-toothed roller 120*a* or composed of flat roller 121 and wart roller 120*b*, in which the comb-toothed roller 120*a* and the wart roller 120*b* are used on the photosensitive surface side and the flat roller 121 is used on the non-photosensitive surface side.

The photosensitive material P is required to be conveyed in a period from the moment of coating a processing solution on the photosensitive surface side to the start of coating a processing solution for the succeeding step, and it is possible to convey the photosensitive material P with the comb-toothed roller 120*a* or the wart roller 120*b* which touches the photosensitive surface side of the photosensitive material P, without causing fluctuation of processing property (processing unevenness).

The comb-toothed roller 120*a* can be formed to comb-teeth having forms shown in FIGS. 21(*a*)–21(*d*), and pitch P1 of crests of comb-teeth 120*a* l is in a range of 1–5 mm and depth H1 of a root of a comb-tooth is in a range of 0.3–5 mm. This comb-tooth roller 120*a* makes it possible to convey surely without causing fluctuation of processing property (processing unevenness).

The wart roller 120*b* can be formed to wart 120*b*1 having forms shown in FIGS. 22(*a*) and 22(*b*), and wart distance D1 is in a range of 1–5 mm and wart height h2 is in a range of 0.3–5 mm. This wart roller 120*b* makes it possible to convey surely without causing fluctuation of processing property (processing unevenness).

In the automatic processing apparatus for photosensitive materials of the present embodiment, a processing step is composed of a plurality of steps, and conveyance means 140 for supplying a processing solution for the succeeding step immediately after coating is represented by paired squeeze nip rollers by means of flat rollers 130 which squeeze-remove a processing solution and coat a processing solution for the succeeding step, to prevent processing unevenness.

In the automatic processing apparatus for photosensitive materials of the present embodiment, there is provided conveying means 140 which is hard roller 140*a* that moves a photosensitive material for coated lines. With regard to coating of a processing solution, if a processing solution sticks to the surface of rubber when a rubber roller is used, residual processing solution and processing unevenness are caused, but in the case of hard roller 140*a*, no processing solution sticks to remain and no processing unevenness is caused.

The hard roller 140*a* is represented by paired nip rollers composed of comb-toothed roller 120*a* and flat roller 130 or composed of wart roller 130*a* and flat roller 130, and no processing solution sticks to remain and no processing unevenness is caused.

When photosensitive material P is a silver halide color photosensitive material and a developing solution is a chromogenic developer, all rollers coming in contact with the chromogenic developer are hard rollers 140*a*, which can prevent processing unevenness that is in a cyanic color and in a spot form in processing of silver halide color photosensitive material.

EFFECT OF THE INVENTION

As stated above, when a processing solution is coated, in a form of lines, on an inclined portion of a photosensitive material conveyed to be inclined downward in its advancing direction, in the invention described in Structure 1, the processing solution does not flow back in the direction opposite to the advancing direction of the photosensitive material, resulting in uniform finishing without processing unevenness.

In the invention described in Structure 2, when an inclination of the conveyance path for a photosensitive material is smaller than 2°, there is a risk that the processing solution flows back in the direction opposite to the advancing direction of the photosensitive material, while, when the inclination is greater than 20°, there is a risk that the processing solution flows fast in the advancing direction of the photosensitive material, and when a photosensitive material is conveyed to be inclined within a range of 2–20°, a processing solution neither flows back in the direction opposite to the advancing direction of the photosensitive material nor flows fast in the advancing direction to cause processing unevenness, resulting in uniform finishing.

In the invention described in Structure 3, the method to jet a processing solution on a photosensitive material from a spray nozzle through a gaseous phase can be used preferably, which makes it possible to process without giving to the exposure section the causes for exposure unevenness such as vibration, deformation of a photosensitive material, and a conveyance stop and slip of the photosensitive material.

In the invention described in Structure 4, by removing processing solutions with paired nip rollers from the photosensitive material inclined downward in its advancing direction, after a processing solution is coated and immediately before entering the succeeding step processing, the processing solution neither enters the succeeding step processing nor flows back in the direction opposite to the advancing direction of the photosensitive material.

In the invention described in Structure 5, when an inclination of the conveyance path for a photosensitive material is smaller than 2°, there is a risk that the processing solution flows back in the direction opposite to the advancing direction of the photosensitive material, while, when the inclination is greater than 20°, there is a risk that the processing solution flows fast in the advancing direction of the photosensitive material, and when a photosensitive material is conveyed to be inclined within a range of 2–20°, a processing solution neither flows back in the direction opposite to the advancing direction of the photosensitive material nor flows fast in the advancing direction to cause processing unevenness, resulting in uniform finishing.

In the invention described in Structure 6, by jetting a chromogenic developer to a silver halide color photosensitive material and by jetting a bleach-fixing solution through a gaseous phase in the succeeding step, it is possible to process without giving to the exposure section the causes for exposure unevenness such as vibration, deformation of a photosensitive material, and a conveyance stop and slip of the photosensitive material.

In the invention described in Structure 7, a direction of a processing solution jetted from a spray nozzle through a gaseous phase is inclined to the advancing direction of a photosensitive material by a prescribed angle, and thereby, the processing solution does not flow back in the direction opposite to the advancing direction of the photosensitive material, resulting in uniform finishing without processing unevenness.

In the invention described in Structure 8, when an inclination angle of a processing solution jetted from spray nozzle 2 is smaller than 70°, there is a fear that the processing solution flows fast in the advancing direction of the photosensitive material, while, when the inclination angle is greater than 88°, there is a fear that the processing solution flows back in the direction opposite to the advancing direction of the photosensitive material, and when the inclination angle for conveyance is in a range of 70–88°, the processing solution does not flow back in the opposite direction and it does not flow fast in the advancing direction to cause processing unevenness, resulting in uniform finishing.

In the invention described in Structure 9, jetting from a spray nozzle is downward in the vertical direction, and a photosensitive material is tilted to be conveyed, and thereby, an angle can be formed by the simple structure, and the processing solution jetted from the spray nozzle neither flows back in the direction opposite to the advancing direction of the photosensitive material nor flows fast in the advancing direction to cause processing unevenness, resulting in uniform finishing.

In the invention described in Structure 10, after a processing solution is coated on a photosensitive side of the photosensitive material, it is necessary to convey the photosensitive material before coating a processing solution for the succeeding step, and in this case, it is possible to convey the photosensitive material without causing fluctuation of processing property (processing unevenness), by using a comb-toothed roller or a wart roller that comes in contact with a photosensitive side of the photosensitive material.

In the invention described in Structure 11, it is possible to convey a photosensitive material surely without causing fluctuation of processing property (processing unevenness), by the use of paired nip rollers wherein a flat roller is arranged for the reverse side of the photosensitive material, in place of a comb-toothed roller or a wart roller.

In the invention described in Structure 12, it is possible to convey a photosensitive material surely without causing fluctuation of processing property (processing unevenness), by the use of a comb-toothed roller.

In the invention described in Structure 13, it is possible to convey a photosensitive material surely without causing fluctuation of processing property (processing unevenness), by the use of a wart roller.

In the invention described in Structure 14, it is possible prevent processing unevenness by coating a processing solution for the succeeding step after removing squeeze-removing a processing solution.

In the invention described in Structure 15, in the case of coating a processing solution, when a rubber roller is used, remaining of a processing solution and processing unevenness are caused when a processing solution sticks to the surface of rubber, but in the case of a hard roller, no processing solution sticks to remain and no processing unevenness is caused.

In the invention described in Structure 16, a hard roller is represented by paired nip rollers composed of a comb-toothed roller and a flat roller or composed of a wart roller and a flat roller.

In the invention described in Structure 17, when a processing solution is chromogenic developer, all rollers coming into contact with the chromogenic developer are hard rollers, and it is possible to prevent processing unevenness in the form of a spot in a cyanic color in a silver halide color photosensitive material.

What is claimed is:

1. An automatic processing apparatus for processing an exposed photographic light-sensitive material by coating a processing solution on the exposed photographic material, comprising:

a conveying device having a conveying path for conveying the exposed photographic material in a conveying direction, a coating device for coating the processing solution on the exposed photographic material by jetting the processing solution from a spray nozzle through a gaseous phase in a direction inclined to the conveying direction with an inclination angle of 70 to 88°.

2. The automatic processing apparatus of claim 1, wherein the coating device jets the processing solution downward vertically from the spray nozzle, and the conveying device conveys the photographic material while inclining the photographic material downward in the conveying direction.

3. The automatic processing apparatus of claim 1, wherein the coating device coats the solution in a coating line perpendicular to the conveying direction and the conveying device comprises one of a comb-toothed roller and a wart roller to convey the photographic material to the coating line, and the one of a comb-toothed roller and a wart roller contacts with a surface of a photosensitive side of the photographic material.

4. The automatic processing apparatus of claim 3, wherein the one of a comb-toothed roller and a wart roller is pared with a flat roller so as to form a pair of nip rollers and the flat roller is provided at a reverse side of the photographic material so that the photographic material is conveyed between the pair of nip rollers.

5. The automatic processing apparatus of claim 3, wherein a pitch of crests of comb-teeth of the comb-toothed roller is in a range of 1–5 mm and a depth of a root of a comb-tooth of the comb-toothed roller is in a rage of 0.3–5 mm.

6. The automatic processing apparatus of claim 3, wherein an interval between warts of the wart roller is within a range of 1–5 mm and a height of a wart of the wart roller is within a range of 0.3–5 mm.

7. The automatic processing apparatus of claim 4, wherein the conveying device comprises a pair of squeezing flat rollers before the conveying device conveys the photographic material to a succeeding processing section after the coating device has coated the processing solution onto the photographic material.

8. The automatic processing apparatus of claim 3, wherein the conveying device comprises a hard roller.

9. The automatic processing apparatus of claim 8, wherein the hard roller is one of a comb-toothed roller and a wart roller which is paired with a flat roller.

10. The automatic processing apparatus of claim 9, wherein when the photographic material is a silver halide color photographic light-sensitive material and the processing solution is a color developing solution, roller coming in contact with the color developing solution are the hard roller.

11. The automatic processing apparatus of claim 1, further comprising a processing solution removing device to remove the processing solution from the photographic material with a pair of nip rollers on a condition that the photographic material is inclined downward in the conveying direction before the conveying device conveys the photographic material to a succeeding processing section after the coating device has coated the processing solution on the photographic material.

12. The automatic processing apparatus of claim 11, wherein the conveying device conveys the photographic material while inclining the photographic material within a range of 2 to 20° downward in the conveying direction.

13. The automatic processing apparatus of claim 11, wherein the photographic material is a silver halide color photographic light-sensitive material; the processing solution is a color developing solution; the succeeding processing section is a bleaching fixing process using a bleaching fixing solution and the succeeding processing section comprises a second coating device for coating a bleach-fixing solution on the photographic material by jetting the bleach-fixing solution from a spray nozzle through a gaseous phase.

* * * * *